US005342058A

United States Patent [19]

Giovannetti

[11] Patent Number: 5,342,058

[45] Date of Patent: Aug. 30, 1994

[54] RED TAPE A GAME OF SKILL AND CHANCE

[76] Inventor: Rafael Giovannetti, 10925 Brittanyln Apt. 30, Tampa, Fl. 33612

[21] Appl. No.: 94,237

[22] Filed: Jul. 21, 1993

[51] Int. Cl.[5] ..... A63F 3/00

[52] U.S. Cl. ..... 273/243

[58] Field of Search ..... 273/242, 243, 248, 249, 273/256, 278, 290

[56] References Cited

U.S. PATENT DOCUMENTS

| | | | |
|---|---|---|---|
| 4,065,131 | 12/1977 | Martin, Jr. et al. | 273/243 |
| 4,179,128 | 12/1979 | Zelazny | 273/243 |
| 4,216,966 | 8/1980 | MacRae | 273/243 |
| 4,216,971 | 8/1980 | Lyke | 273/243 |
| 4,279,422 | 7/1981 | Shaw | 273/243 X |
| 4,900,031 | 2/1990 | Wohl | 273/243 |
| 4,900,032 | 2/1990 | Erickson et al. | 273/243 |

FOREIGN PATENT DOCUMENTS

| | | | |
|---|---|---|---|
| 2183493 | 6/1987 | United Kingdom | 273/243 |
| 2231277 | 11/1990 | United Kingdom | 273/243 |

*Primary Examiner*—William Stoll

*Attorney, Agent, or Firm*—Richard L. Miller

[57] ABSTRACT

A red tape game of skill and chance is provided which consists of a game board having a continuous path of playing positions around its perimeter, a set a playing pieces for each player, a pair of dice to determine the movement of the playing pieces along the playing positions, play money for each player, a bank account book for each player, tokens to be purchased for rides on a subway, and situation cards with instructions thereon to be picked by each player during the play of the game. Playing piece are also provided which are hollow cone-shaped members, so that each playing piece of the same set can be stacked one upon the other to move along the playing positions on the game board. The playing pieces further include an element for temporarily locking together a plurality of such hollow cone-shaped stacked members so that they may easily be moved as a unit during play without inadvertently becoming separated.

4 Claims, 3 Drawing Sheets

Fig. 1A
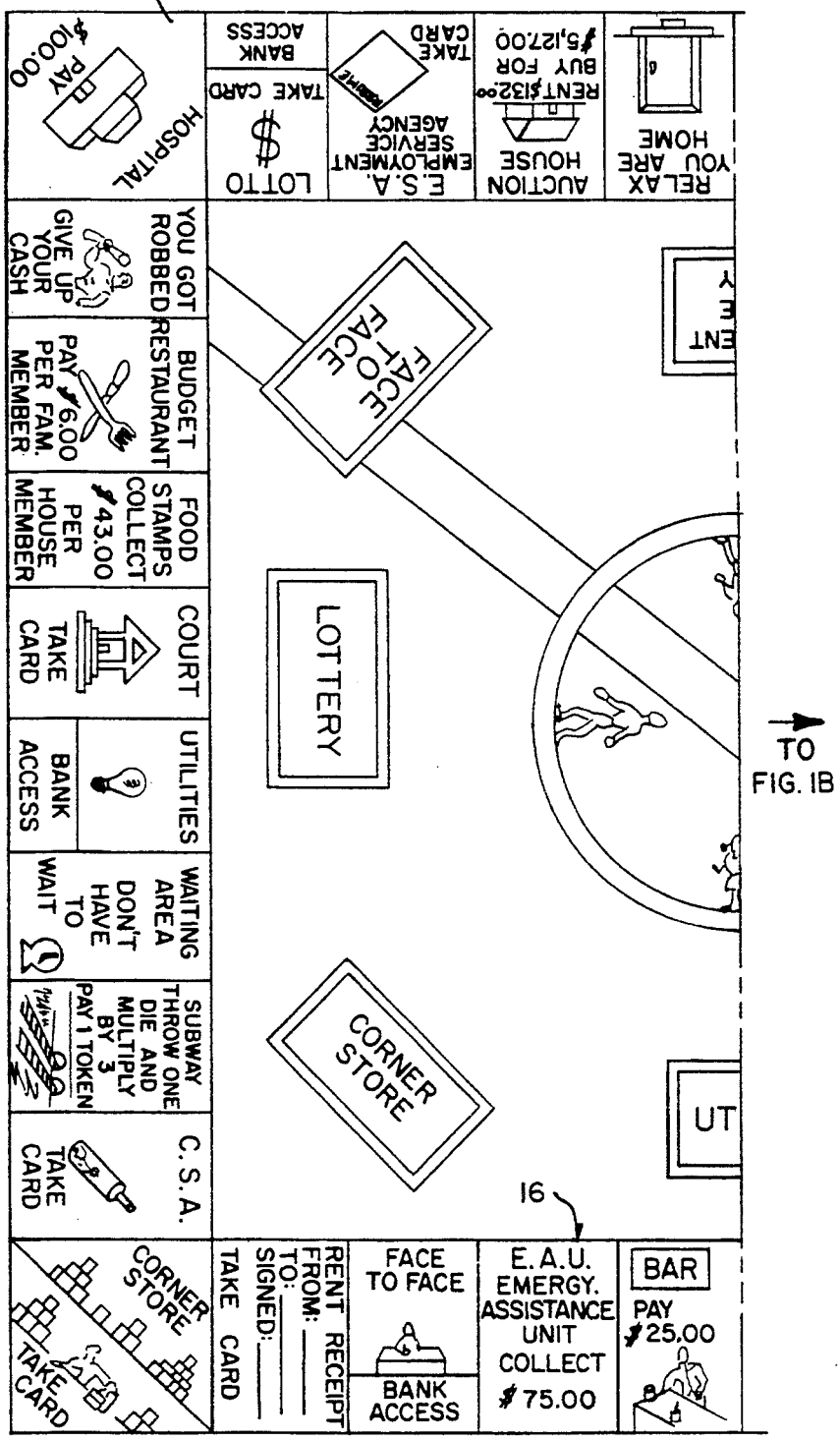
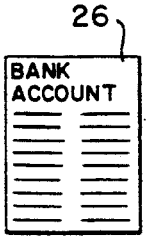
Fig. 2
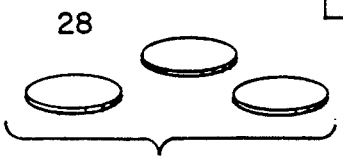
Fig. 3

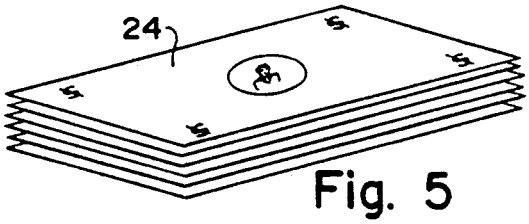
Fig. 5
Fig. 6
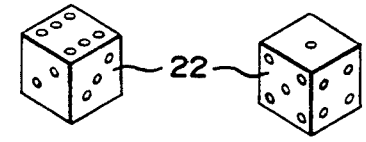
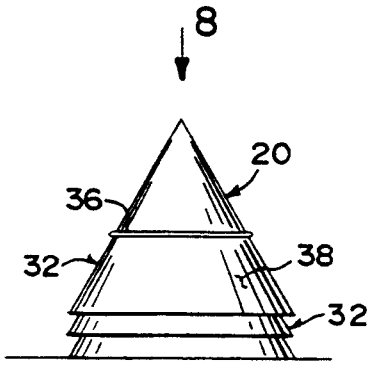
Fig. 7
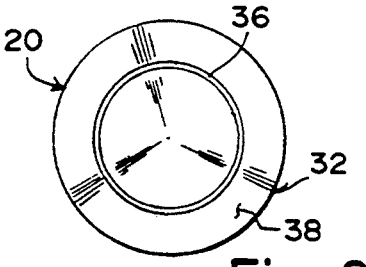
Fig. 8
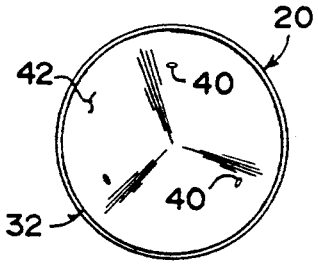
Fig. 10
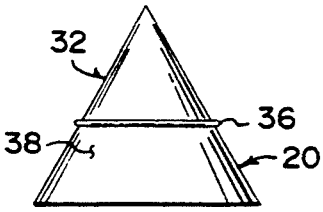
10
Fig. 9
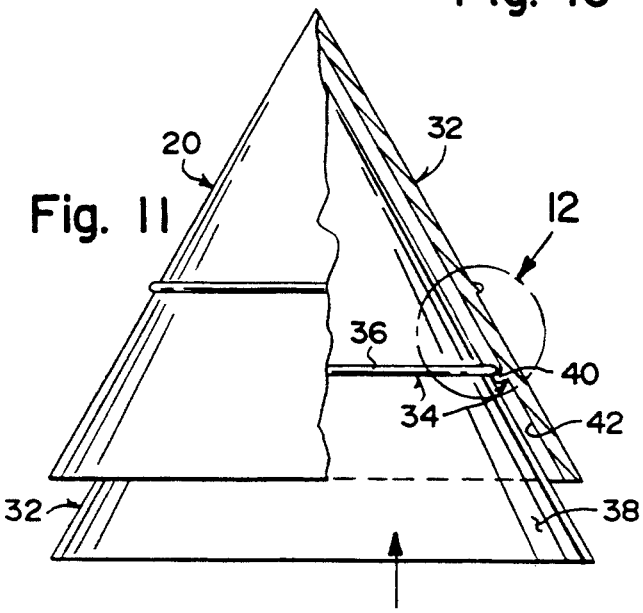
Fig. 11
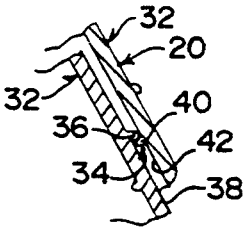
Fig. 12

RED TAPE A GAME OF SKILL AND CHANCE

BACKGROUND OF THE INVENTION

The instant invention relates generally to board games and more specifically it relates to a red tape game of skill and chance.

Numerous board games have been provided in the prior art that are adapted to include playing pieces that are moved along designated paths on games boards. For example, U.S. Pat. Nos. 4,119,321 to Creel; 4,480,838 to Aharonian and 4,884,818 to Fogarty all are illustrative of such prior art. While these units may be suitable for the particular purpose to which they address, they would not be as suitable for the purpose of the present invention as hereafter described.

SUMMARY OF THE INVENTION

A primary object of the present invention is to provide a red tape game of skill and chance that will overcome the shortcomings of the prior art devices.

Another object is to provide a red tape game of skill and chance which utilizes every day struggling events of generally poor families as the background situation for the game.

An additional object is to provide a red tape game of skill and chance in which the way to win the game is for a player to accumulate enough money to buy a house first.

A further object is to provide a red tape game of skill and chance that is simple and easy to use.

A still further object is to provide a red tape game of skill and chance that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 2 is a diagrammatic top plan view of bank account book used in playing the game;

FIG. 3 is a diagrammatic perspective view of tokens used in playing the game;

FIG. 5 is a diagrammatic perspective view of play money used in playing the game;

FIG. 6 is a diagrammatic perspective view of a pair of conventional dice used in playing the game;

FIG. 7 is a diagrammatic side elevational view of three playing pieces stacked one upon the other;

FIG. 8 is a diagrammatic top plan view taken in the direction of arrow 8 in FIG. 7;

FIG. 9 is a diagrammatic side elevational view similar to FIG. 7 but of just a single playing piece per se;

FIG. 10 is a diagrammatic bottom plan view taken in the direction of arrow 10 in FIG. 9;

FIG. 11 is a greatly enlarged diagrammatic side elevational view of two playing pieces with one shown partially in section having parts broken away so as to illustrate how these pieces lock together; and FIG. 12 is a diagrammatic cross sectional view of the area indicated by arrow 12 in FIG. 11.

DETAILED DESCRIPTION OF THE PREFERRED EMBODIMENTS

Figure 1B:
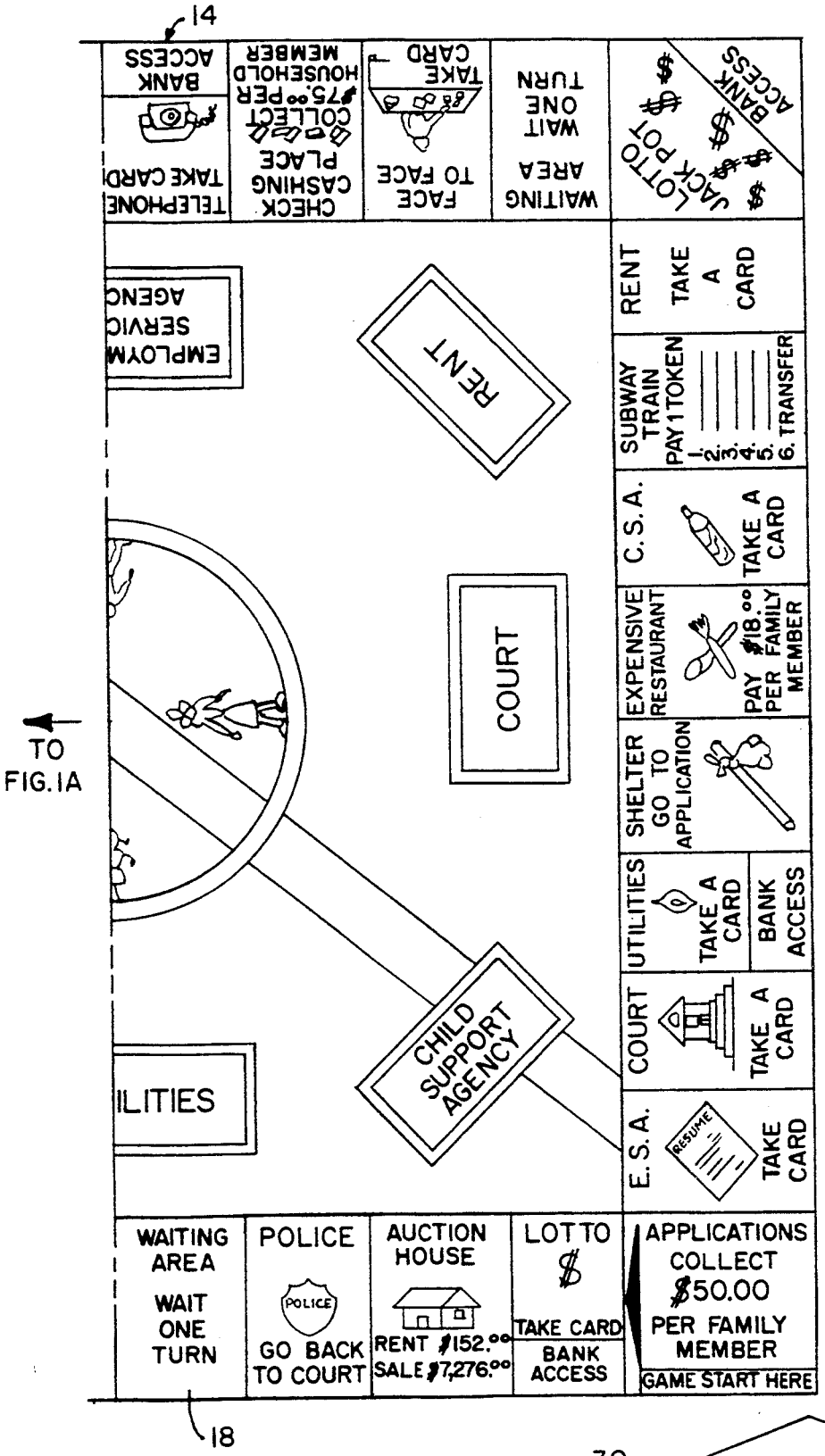
FIG. 1 is a diagrammatic top plan view of the game board of the instant invention.
Figure 4:
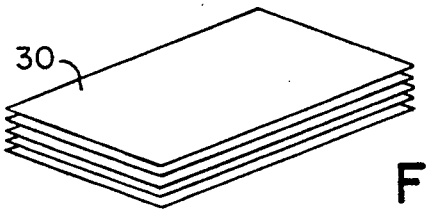
FIG. 4 is a diagrammatic perspective view of situation cards used in playing the game.

Turning now descriptively to the drawings, in which similar reference characters denote similar elements throughout the several views, the Figures illustrate a red tape game of skill and chance which consists of a game board 14 having a continuous path 16 around its perimeter divided into consecutive spaces defining playing positions 18, in which some playing positions 18 bear instructions representing amounts of money to be paid and received during the game. A plurality of sets of different identified playing pieces 20 are provided, in which at the start of the game three playing pieces 20 of the same set represents a family for each of the game players. The playing pieces 20 are of a size to fit within the playing positions 18. A pair of dice 22 are for producing a random count to determine the magnitude of movement for the playing pieces 20 along the playing positions 18 on the game board 14. Play money 24 of different denominations are for distribution of part thereof to each player. A bank account book 26 is for each player, so that each player can keep a written,-record of money deposited into and withdrawn from a bank account during the game. A plurality of tokens 28 are for purchase by each player, so as to ride on a subway during the game. A plurality of situation cards 30 are also provided, with each having instructions thereon. When a player lands on a playing position 18 indicating a pick of one situation card 30, the player will follow the instructions.

Each playing piece 20 is a hollow cone-shaped member 32. The playing pieces 20 of the same set can be stacked one upon the other as to be move along the playing positions 18 as a set, without being inadvertently separated, on the game board 14, as a family for each player during the game.

A mechanism 34 is for temporarily locking together two hollow cone-shaped members 32 being the playing pieces 20 of the same set when stacked one upon the other. The temporary locking mechanism 34 includes a raised band 36 formed about an exterior surface 38 of each hollow cone-shaped member 32. A plurality of small protuberances 40 are formed in spaced apart aligned positions about an interior surface 42 of each hollow cone-shaped member 32. When two hollow cone-shaped members 32 are stacked one upon the other, the small protuberances 40 on the upper hollow cone-shaped member 32 are located, so that they will snap under the raised band 36 on the lower hollow cone-shaped member 32 if a slight force is applied.

APPENDIX—GAME INSTRUCTIONS

The game starts at the playing position 18 on the game board 14 labeled "Applications". From there the players move clockwise. The two dice 22 are used to determine how many spaces each player will move ahead. A player does not throw again when a double number is rolled with the dice 22. Every player starts the game with $250.00 in play money 24 and $1,000.00 in the bank. The savings account balance is kept by every player in the bank account book 26. Every time that a player deposits money in the bank account, the amount has to be added in the bank account book 26. And every time that a player withdraws money from the bank account it has to be subtracted from the bank account book 26. It is recommended not to hold too much cash; because if a player gets robbed, the player will loose whatever cash money the player has on his person. There are seven playing positions 18 in which a player can withdraw and deposit money. A player has to be at one of these branches in order to make a transaction.

There are eight playing positions 18, in which a player has to take a situation card 30 and follow the instructions stated on the card. These playing positions 18 are:

1) LOTTO: At the lotto a player could win or loose money and could even win the LOTTO JACK POT. Whatever money a player looses at the lotto, it has to be deposited on the LOTTO JACK POT corner. All the money that a player wins is collected from the bank, only when the player wins jack pot the player will take jack pot. The jack pot always starts at $600.00. After the jack pot is collected the bank will place another $600.00 at jack pot.
2) FACE TO FACE: The face to face is a personal interview with a social worker who evaluates a player's situation and determines what action has to be taken in the case. This worker can add or remove dependants from a player's family. The worker can also issue play money 24 to a family for emergency assistance. The same way that the worker can issue money, the worker can also recoup money which was issued in error or was not entitled to a player. This worker can also refer a player to other agencies. The player must make any money transactions with the bank.
3) RENT: At this location a player deals with rent problems, such as paying rent if it hasn't been paid. All payments are made to the bank.
4) CORNER STORE: At this location a player goes shopping for food and groceries. All payments are made to the bank.
5) CHILD SUPPORT AGENCY: This agency can take player's children away or give them back. They also enforce alimony collections. All money transactions are made to the bank.
6) UTILITIES: At this location a player pays the telephone, light and gas bills to the bank.
7) COURT: This is where a player solves court problems with the landlord/tenant court, fair hearings and family court. Here a player can loose custody of all their children, in that case, the player will remain with only one family member. A player may also have to pay or collect money from the bank.
8) EMPLOYMENT SERVICE AGENCY: The employment service agency can indicate to a player's social worker that the player has to be sanctioned from their budget if they don't comply with the agency requirements. This agency's main purpose is to help players find a job.

There are four playing positions 18 on which a player automatically collects money. These playing position 18 are:

1) APPLICATIONS: A player collects play money 24 at applications only when stopped at this location. Collect $50.00 per household member.
2) E.A.U.: The Emergency Assistance Unit helps a player after working hours when the player cannot get in touch with any other government office in order to get emergency help. Collect $73.00 from the bank.
3) FOOD STAMPS: Food coupons to help the low income families get a good nutritious diet. Collect $20.00 from the bank per household member.
4) CHECK CASHING PLACE: At the check cashing place, a player will collect $75.00 per household member as player passes this space. The bigger the family the more money the player gets.

There are five playing positions 18, in which a player has to pay a preset amount of money. These playing positions 18 are:

1) EXPENSIVE RESTAURANT: At the expensive restaurant a player will pay $41.00 per family member plus a 20% tip.
2) BUDGET RESTAURANT: At this restaurant a player will pay $32.00 per family member plus a 15% tip.
3) THE BAR: At the bar a player has to pay $25.00 plus $3.00 tip.
4) THE PRIVATE HOUSE: At the private house a player has the option of renting or buying the house. If the player can't buy the house, then the player has to pay the rent to the bank. But whoever buys a house first wins the game. There are two houses with two different prices. One of them can be rented for $218.00 or be bought with a down payment of $5,000.00. The other house can be rented for $152.00 or be bought with a down payment of $7,276.00.

There are two waiting areas. On one a player has to wait one turn. At the other waiting area the player doesn't have to wait and can continue to play on their next turn.

The subway takes each player to different places around the game board 14. Whenever a player stops at the subway, they have to pay one token 28. If they don't have a token 28 when stopped by the subway, the player has to buy a token 28 and wait for the next turn to move on. If a player has a token 28 they just pay the fair and go ahead with their move. A player can only buy tokens 28 at the subway, at a price of $2.00 each.

If a player stops at the shelter on their next move, they don't throw the dice 22 and just go directly to applications.

The family members are indicated by the amount of hollow cone-shaped members 32 that a player uses to move around the game board 14. Every player starts with three family members.

Every player holds a bank account book 26, on which the record of the bank account balance must be kept. A player can only deposit or withdraw play money 24 at the seven locations marked "BANK ACCESS".

If a player does not have enough cash to pay a debt and not have bank access at that time, but has money saved, the player can be granted credit until he or she gets to a bank access space, but a $50.00 penalty will have to be paid to the bank by the player.

Any player who runs out of money can get credit from the bank for the exact amount of money owed but will have to play the bank $25.00 extra for interest fee per loan. The money owed to the bank will be garnished from any payments that the player is to receive.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A red tape game of skill and chance which comprises:

a) a game board having a continuous path around its perimeter divided into consecutive spaces defining playing positions, in which some playing positions bear instructions representing amounts of money to be paid and received during the game;

b) a plurality of sets of different identified playing pieces, in which at the start of the game three said playing pieces of the same set represents a family for each of the game players, said playing pieces being of a size to fit within the playing positions;

c) a pair of dice for producing a random count to determine the magnitude of movement for said playing pieces along the playing positions;

d) play money of different denominations for distribution of part thereof to each player;

e) a bank account book for each player, so that each player can keep a written record of money deposited into and withdrawn from a bank account during the game;

f) a plurality of tokens for purchase by each player, so as to ride on a subway during the game; and g) a plurality of situation cards, each having instructions thereon, so that when a player lands on a playing position indicating a pick of one said situation card, the player will follow the instructions.

2. A red tape game of skill and chance as recited in claim 1, wherein each said playing piece is a hollow cone-shaped member, so that said playing pieces of the same set can be stacked one upon the other to move along the playing positions on said game.

3. A red tape game of skill and chance as recited in claim 2, further including means for temporarily locking together two said hollow cone-shaped members, being said playing pieces of the same set, when stacked one upon the other.

4. A red tape game of skill and chance as recited in claim 3, wherein said temporary locking means includes:

a) a raised band formed about an exterior surface of each said hollow cone-shaped member; and b) a plurality of small protuberances formed in spaced apart aligned positions about an interior surface of each said hollow cone-shaped member, so that when two said hollow cone-shaped members are stacked one upon the other, said small protuberances on upper said hollow cone-shaped members are located, so that they will snap under said raised band on lower said hollow cone-shaped member.

* * * * *